US009639022B2

(12) United States Patent
Hoshino

(10) Patent No.: US 9,639,022 B2
(45) Date of Patent: May 2, 2017

(54) POWER SUPPLY STRUCTURE, CHARGING DEVICE, ASSEMBLY, AND IMAGE FORMING APPARATUS

(71) Applicant: FUJI XEROX CO., LTD., Tokyo (JP)

(72) Inventor: Yuta Hoshino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/921,505

(22) Filed: Oct. 23, 2015

(65) Prior Publication Data

US 2016/0378014 A1 Dec. 29, 2016

(30) Foreign Application Priority Data

Jun. 29, 2015 (JP) ..... 2015-130153

(51) Int. Cl.
*G03G 15/02* (2006.01)

(52) U.S. Cl.
CPC ..... *G03G 15/0283* (2013.01); *G03G 15/0216* (2013.01)

(58) Field of Classification Search
CPC ..... G03G 15/0216; G03G 15/0233; G03G 15/0283; G03G 2215/021
See application file for complete search history.

(56) References Cited

U.S. PATENT DOCUMENTS 5,768,660 A * 6/1998 Kurihara ..... G03G 15/0216 361/221
5,950,047 A * 9/1999 Miyabe ..... G03G 21/1867 399/111

FOREIGN PATENT DOCUMENTS

JP H11-231721 A 8/1999

* cited by examiner

*Primary Examiner* — Erika J Villaluna
(74) *Attorney, Agent, or Firm* — Oliff PLC

(57) ABSTRACT

A power supply structure includes a bearing, a first spring, and a second spring. The bearing supports a rotary member that axially rotates while contacting with a contact target. While receiving power, the first spring contacts with and presses the bearing with an end portion of the first spring to bring the rotary member into contact with the contact target. The second spring extends from the first spring toward the contact target and contacts with the rotary member.

9 Claims, 7 Drawing Sheets

POWER SUPPLY STRUCTURE, CHARGING DEVICE, ASSEMBLY, AND IMAGE FORMING APPARATUS

CROSS-REFERENCE TO RELATED APPLICATIONS

This application is based on and claims priority under 35 USC 119 from Japanese Patent Application No. 2015-130153 filed Jun. 29, 2015.

BACKGROUND

Technical Field

The present invention relates to a power supply structure, a charging device, an assembly, and an image forming apparatus.

SUMMARY

According to an aspect of the invention, there is provided a power supply structure including a bearing, a first spring, and a second spring. The bearing supports a rotary member that axially rotates while contacting with a contact target. While receiving power, the first spring contacts with and presses the bearing with an end portion of the first spring to bring the rotary member into contact with the contact target. The second spring extends from the first spring toward the contact target and contacts with the rotary member.

BRIEF DESCRIPTION OF THE DRAWINGS

An exemplary embodiment of the present invention will be described in detail based on the following figures, wherein.

DETAILED DESCRIPTION

Overview

Figure 1:
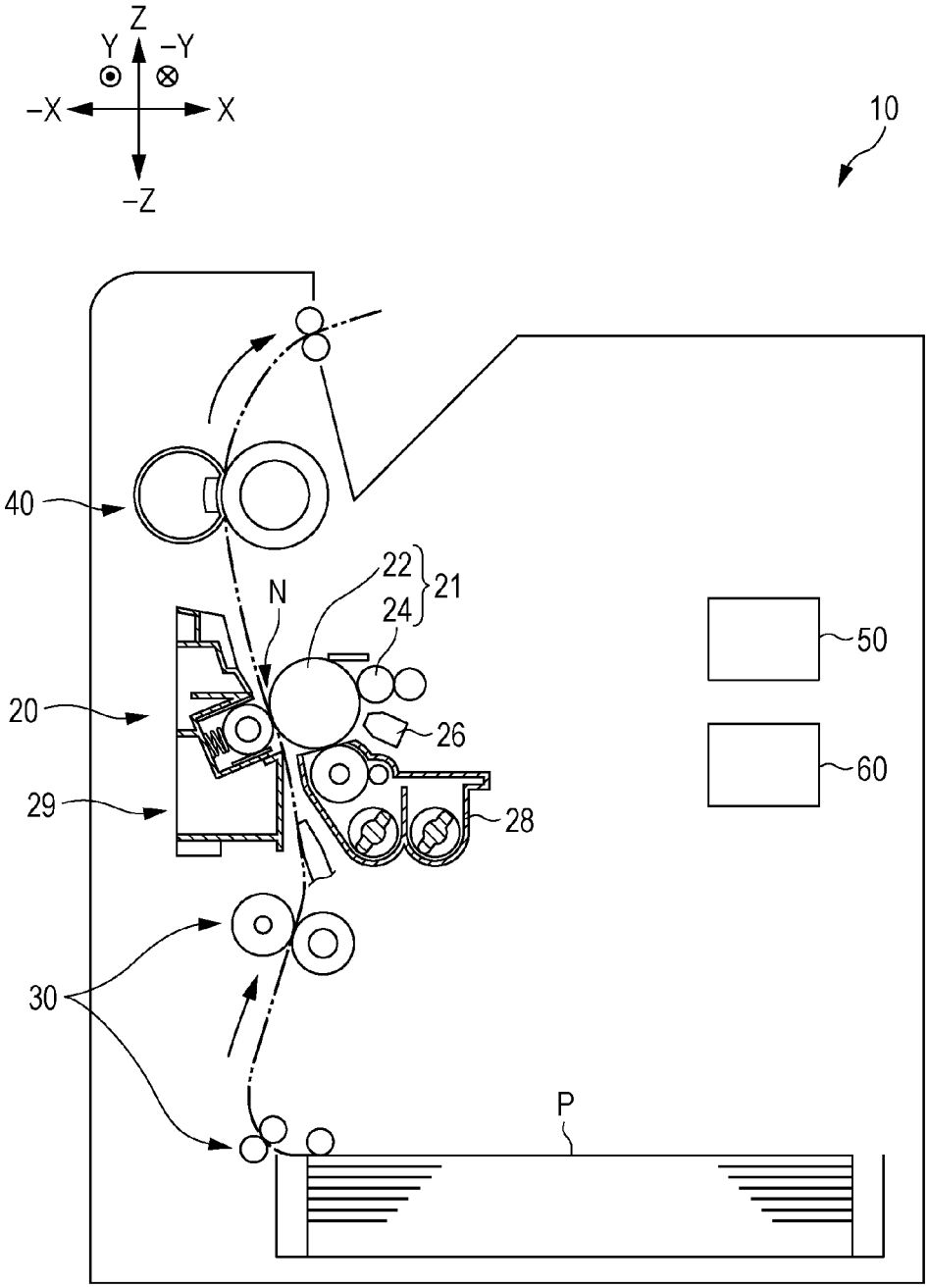
FIG. 1 is a schematic diagram (front view) of an image forming apparatus according to the exemplary embodiment.

An exemplary embodiment for implementing the invention (hereinafter referred to as the exemplary embodiment) will be described below. An overall configuration and an operation of an image forming apparatus 10 according to the exemplary embodiment will first be described. A configuration of a major part of the exemplary embodiment (a charging device 24) will then be described. Then, functions of the exemplary embodiment will be described.

In the following description, a direction indicated by arrow X or -X in the drawings is an apparatus width direction, and a direction indicated by arrow Z or -Z in the drawings is an apparatus height direction. Further, a direction perpendicular to each of the apparatus width direction and the apparatus height direction (the direction of arrow Y or -Y) is an apparatus depth direction.

Overall Configuration of Image Forming Apparatus

An overall configuration of the image forming apparatus 10 will first be described with reference to FIG. 1. The image forming apparatus 10 is an apparatus employing an electrophotographic system including a toner image forming unit 20, a transport device 30, a fixing device 40, a high-voltage power supply 50, and a controller 60.

Toner Image Forming Unit

The toner image forming unit 20 has a function of performing respective processes of charging, exposure, development, and transfer to form a toner image on a medium P transported by the transport device 30.

The toner image forming unit 20 includes a photoconductor 22, the charging device 24, an exposure device 26, a developing device 28, and a transfer device 29.

The photoconductor 22 is driven to axially rotate by a drive source (illustration omitted). The charging device 24 has a function of charging the axially rotating photoconductor 22. The exposure device 26 has a function of forming a latent image on the charged photoconductor 22. The developing device 28 has a function of developing the latent image formed on the photoconductor 22 by the exposure device 26 into a toner image by using toner (illustration omitted). The transfer device 29 has a function of transferring the toner image developed on the photoconductor 22 onto the medium P at a nip N (a nip formed by the photoconductor 22 and the transfer device 29). Herein, the photoconductor 22 is an example of a contact target and an example of a member to be charged. The exposure device 26 is an example of a latent image forming unit. The developing device 28 is an example of a developing unit. The transfer device 29 is an example of a transfer unit.

A configuration including the photoconductor 22 and the charging device 24 forms a cartridge 21 attachable to the body of the image forming apparatus 10. That is, the cartridge 21 integrally includes the photoconductor 22 and the charging device 24. Herein, the cartridge 21 is an example of an assembly.

Transport Device, Fixing Device, and High-Voltage Power Supply

The transport device 30 has a function of transporting the medium P to pass the medium P through the toner image forming unit 20 and the fixing device 40. In the drawing, arrows indicate a transport direction of the medium P, and a dashed and double-dotted line indicates a transport path of the medium P. The fixing device 40 has a function of applying heat and pressure to the toner image formed on the medium P by the toner image forming unit 20 to fix the toner on the medium P. The high-voltage power supply 50 has a function of supplying (feeding) power to the charging device 24, the developing device 28, and the transfer device 29.

Controller

The controller 60 has a function of controlling components other than the controller 60 forming the image forming apparatus 10. Specific functions of the controller 60 will be described in a description of the operation of the image forming apparatus 10.

The above is a description of the overall configuration of the image forming apparatus 10 according to the exemplary embodiment.

Operation of Image Forming Apparatus

The operation of the image forming apparatus 10 according to the exemplary embodiment will now be described with reference to FIG. 1.

The controller 60 receives image data from an external device (illustration omitted), and operates the toner image forming unit 20 and the high-voltage power supply 50. Then, the charging device 24 charges the photoconductor 22, and the exposure device 26 exposes the photoconductor 22 to light. Further, the developing device 28 develops a latent image to thereby form a toner image on the photoconductor 22.

The controller 60 further operates the transport device 30 to send the medium P to the nip N in synchronization with the arrival of the toner image formed on the photoconductor 22 to the nip N with the rotation of the photoconductor 22. The controller 60 then causes the transfer device 29 to transfer the toner image formed on the photoconductor 22 onto the medium P.

Then, the fixing device 40 applies heat and pressure to the toner image transferred to the medium P by the transfer device 29 to fix the toner image on the medium P. The medium P having the toner image fixed thereon is then discharged to the outside of the image forming apparatus 10 by the transport device 30, and the operation of the image forming apparatus 10 is completed.

The above is a description of the operation of the image forming apparatus 10.

Configuration of Major Part

A major part of the exemplary embodiment (the charging device 24) will now be described with reference to FIGS. 2 and 3. The charging device 24 includes a charging roller 70, a cleaning roller 80 (hereinafter referred to as the CLR 80), a pair of bearings 90, and a spring 100.

Charging Roller

The charging roller 70 has a function of axially rotating while contacting with the photoconductor 22 to charge the photoconductor 22. Herein, the charging roller 70 is an example of a rotary member and an example of a charging member.

The charging roller 70 includes a shaft 72 and a cylindrical body 74. The body 74 is provided around the outer circumference of the shaft 72 with opposite ends of the shaft 72 projecting from the body 74. That is, the body 74 is provided around the outer circumference of the shaft 72 with at least one end of the shaft 72 projecting from the body 74. Further, the body 74 is in contact with the outer circumference of the photoconductor 22. Further, the charging roller 70 is driven to rotate by the photoconductor 22 in accordance with the rotation of the photoconductor 22. Herein, the shaft 72 is an example of a rotary shaft. Further, the body 74 is an example of a contact portion. The shaft 72 according to the exemplary embodiment is made of metal, for example. Further, although FIGS. 2 and 3 illustrate a near-side part of the charging roller 70 in the apparatus depth direction, a depth-side part of the shaft 72 in the apparatus depth direction is formed with a D-cut portion (illustration omitted) fitted with a gear (illustration omitted).

Cleaning Roller

The CLR 80 has a function of cleaning toner, paper dust, and other impurities adhering to the body 74 of the charging roller 70 from the body 74. The CLR 80 includes a shaft 82 and a cylindrical foam member 84. The foam member 84 is provided around the outer circumference of the shaft 82 with opposite ends of the shaft 82 projecting from the foam member 84. Further, the foam member 84 is in contact with the body 74 of the charging roller 70. A depth-side part of the shaft 82 in the apparatus depth direction is formed with a D-cut portion (illustration omitted) fitted with a gear (illustration omitted) that engages with the gear of the charging roller 70. Further, the CLR 80 is driven to rotate in accordance with the rotation of the charging roller 70.

Bearings

The paired bearings 90 have a function of supporting the charging roller 70 and a function of supporting the CLR 80. The paired bearings 90 are respectively disposed on the near side and the depth side in the apparatus depth direction. Hereinafter, the bearing 90 on the near side in the apparatus depth direction will be described as the bearing 90A, and the bearing 90 on the depth side in the apparatus depth direction will be described as the bearing 90B. FIGS. 2 and 3 illustrate the bearing 90A on the near side in the apparatus depth direction. Further, the bearing 90A according to the exemplary embodiment has an insulating property, for example.

The bearing 90A has a rectangular parallelepiped shape, and is disposed to face the photoconductor 22. Hereinafter, a surface of the bearing 90A facing the photoconductor 22 will be described as the end surface 91, and a surface of the bearing 90A opposite to the end surface 91 will be described as the end surface 92. Further, a surface of the bearing 90A facing the near side in the apparatus depth direction will be described as the side surface 93.

The bearing 90A includes two through-holes 94 and 95 aligned in a radial direction of the photoconductor 22 and passing through in the apparatus depth direction. Herein, the through-hole 94 is formed on the side of the end surface 91 (on the side of the photoconductor 22) in the radial direction of the photoconductor 22, and the through-hole 95 is formed on the side of the end surface 92 in the radial direction of the photoconductor 22. Further, the shaft 72 of the charging roller 70 is fitted in the through-hole 94 of the bearing 90A, and the shaft 82 of the CLR 80 is fitted in the through-hole 95 of the bearing 90A. The bearing 90A supports the charging roller 70 and the CLR 80 with the shafts 72 and 82 passing through the through-holes 94 and 95, respectively.

The end surface 92 is provided with a cylindrical projection 96 projecting outward in the radial direction of the photoconductor 22. The projection 96 has a function of positioning one end portion of a later-described coil spring 102.

The side surface 93 is formed with two protrusions 97 and 98 protruding toward the near side (outward) in the apparatus depth direction. The protrusions 97 and 98 have a function of supporting a later-described linear spring 104. In the following description, the radial direction of the photoconductor 22 passing through a shaft center O of the charging roller 70 will be described as the first direction (the direction of arrow A), and a direction perpendicular to the first direction and the axial direction of the charging roller 70 (the apparatus depth direction) will be described as the second direction (the direction of arrow B), as illustrated in FIG. 2. Further, the protrusions 97 and 98 are displaced from each other in the first direction and the second direction.

The above is a description of the configuration of the bearing 90A. The not-illustrated bearing 90B is similar in configuration to the bearing 90A except that the bearing 90B is not formed with the protrusions 97 and 98.

Spring

The spring 100 has a function of contacting with and pressing the bearing 90A to bring the charging roller 70 (the body 74 thereof) into contact with the photoconductor 22 (with the spring 100 receiving power from the high-voltage power supply 50) and a function of contacting with the charging roller 70. The spring 100 includes the coil spring 102 and the linear spring 104. Herein, the coil spring 102 is an example of a first spring, and the linear spring 104 is an example of a second spring. The spring 100 according to the exemplary embodiment is made of metal, for example.

Coil Spring

The coil spring 102 has a function of contacting with the bearing 90A (the end surface 92 thereof) and pressing the bearing 90A to bring the charging roller 70 into contact with the photoconductor 22 (with the coil spring 102 receiving power from the high-voltage power supply 50). Specifically, the coil spring 102 is disposed in a compressed state between the end surface 92 of the bearing 90A and an electrode 114 provided to a wall 110 of the cartridge 21 and connected to the high-voltage power supply 50. The one end portion of the coil spring 102 is fitted around the projection 96 of the bearing 90A to be positioned by the projection 96. The other end portion of the coil spring 102 is in contact with and fitted around the electrode 114, which forms a cylindrical projection projecting from the wall 110, to be positioned by the electrode 114.

Linear Spring

The linear spring 104 has a function of contacting with the charging roller 70. Further, the linear spring 104 is provided to extend from the end portion of the coil spring 102 on the side of the end surface 92 (the side in contact with the bearing 90A) toward the end surface 91 (toward the photoconductor 22). Herein, "provided to extend" indicates that the linear spring 104 is formed not as a member separated from the coil spring 102 but integrally with the coil spring 102 (the linear spring 104 and the coil spring 102 are not plural members connected together).

The linear spring 104 includes a connecting portion 104A, a linear portion 104B, and a contact portion 104C, which are connected together in this order.

The connecting portion 104A is a portion disposed along the end surface 92 of the bearing 90A to extend from the end portion of the coil spring 102 on the side of the end surface 92 to an end of the side surface 93.

The linear portion 104B is a portion disposed along the side surface 93 to extend from an end portion of the side surface 93 on the side of the end surface 92 to a position before the through-hole 94 along the radial direction of the photoconductor 22 (linearly). The linear portion 104B and the connecting portion 104A are connected together with a boundary portion thereof bent. Further, the linear portion 104B is disposed between and in contact with the protrusions 97 and 98 displaced from each other in the first direction and the second direction. Further, the linear portion 104B is supported by the protrusions 97 and 98.

The contact portion 104C is a portion disposed to face the side surface 93 and contacting with the shaft 72 of the charging roller 70. Specifically, the contact portion 104C is in (direct) contact with the outer circumference of the shaft 72. Further, with the linear portion 104B supported by the protrusions 97 and 98, the contact portion 104C is elastically deformed, that is, contacts with and presses the outer circumference of the shaft 72. A portion of the contact portion 104C opposite to a portion of the contact portion 104C connected to the linear portion 1043 is bent in a circular arc shape.

Supplementary Notes

Unlike the bearing 90A, the bearing 90B is pressed by a coil spring (illustration omitted) that contacts with the end surface 92 to bring the charging roller 70 into contact with the photoconductor 22.

The above is a description of the configuration of the charging device 24. A power supply structure 25 of the charging device 24, which includes the bearing 90A, the coil spring 102, and the linear spring 104, is an example of a power supply structure.

Functions

Functions of the exemplary embodiment will now be described.

Functions (first to fifth functions) of the exemplary embodiment will first be described in comparison with comparative embodiments (first to fifth comparative embodiments) supposed below. If the same components and so forth as those employed in the exemplary embodiment are used in the description of the comparative embodiments, the reference signs of the components and so forth employed in the exemplary embodiment will directly be used, even if the components and so forth are not illustrated.

First Function

The first function is provided by bringing the spring 100 (the linear spring 104) into (direct) contact with the charging roller 70 to supply power to the charging roller 70. The first function will be described below in comparison of the exemplary embodiment with the first comparative embodiment.

Figure 3:
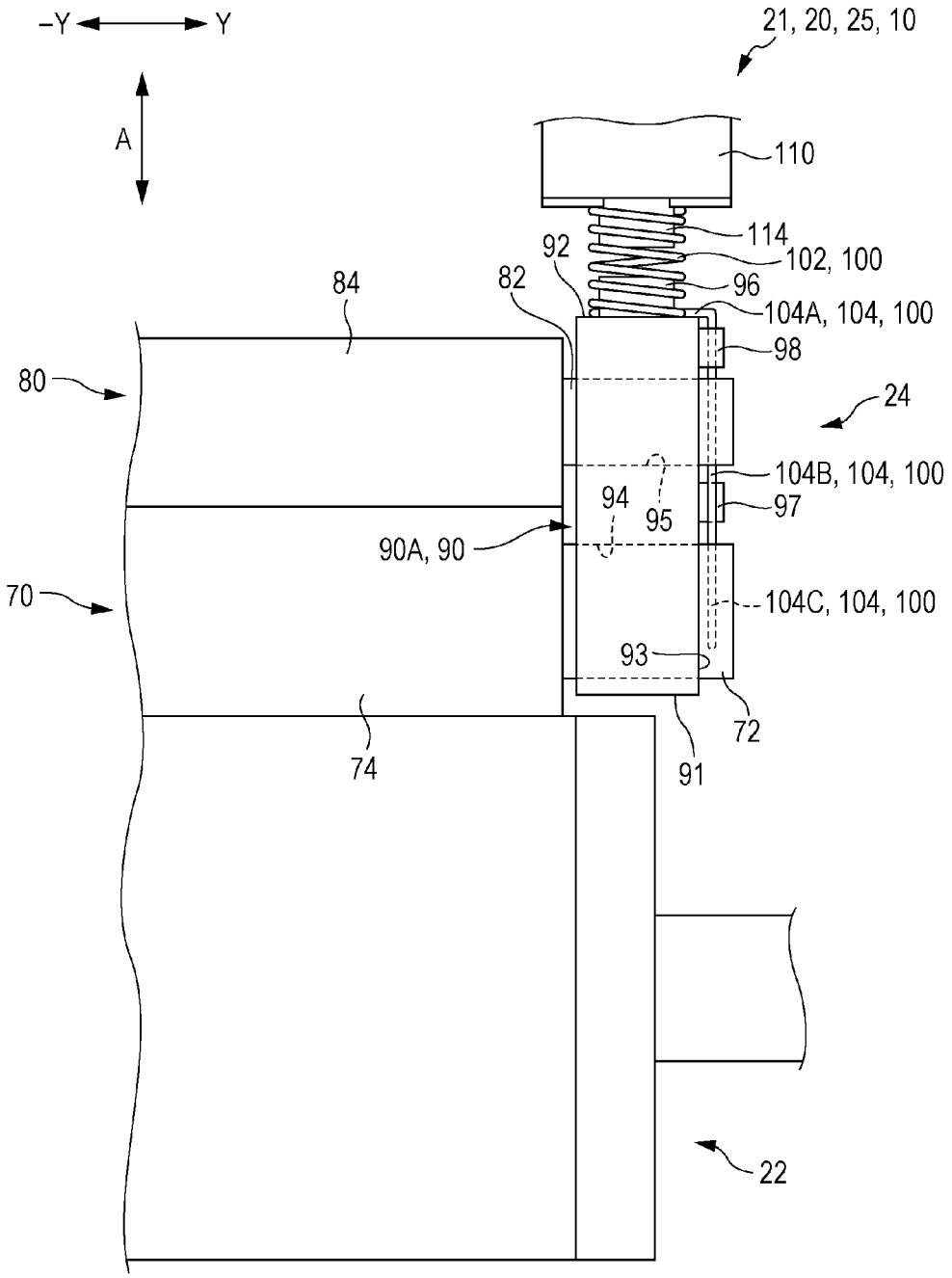
FIG. 3 is a schematic diagram illustrating parts of the integrated cartridge according to the exemplary embodiment, as viewed in a direction intersecting the axial direction of the charging roller.
Figure 4:
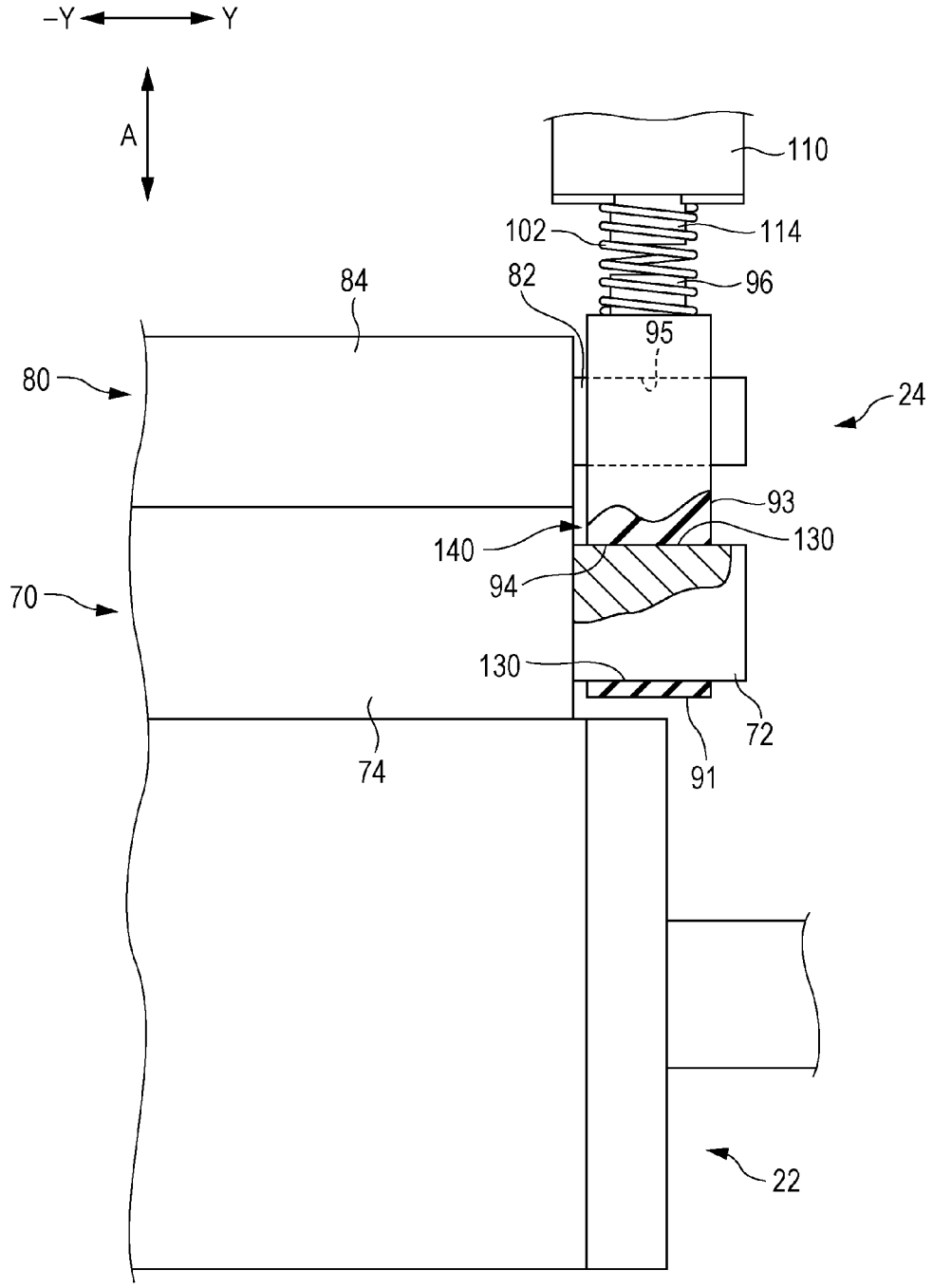
FIG. 4 is a schematic diagram illustrating parts of a photoconductor and a charging device according to a first comparative embodiment, as viewed in the direction intersecting the axial direction of the charging roller.

A charging device 24A according to the first comparative embodiment (see FIG. 4) includes the coil spring 102 and a conductive bearing 140 in place of the spring 100 and the bearing 90A of the charging device 24 according to the exemplary embodiment (see FIG. 3). Herein, the conductive bearing 140 is similar in configuration to the bearing 90A according to the exemplary embodiment except that the conductive bearing 140 has conductivity. Further, in the charging device 24A, the coil spring 102 connected to the high-voltage power supply 50 presses the conductive bearing 140 to supply power to the charging roller 70 via the conductive bearing 140 and conductive paste 130 adhering to the outer circumference of the shaft 72 of the charging roller 70. That is, in the first comparative embodiment, the power from the high-voltage power supply 50 is supplied to the charging roller 70 via the coil spring 102 and the conductive bearing 140, which is a member separated from the coil spring 102. The charging device 24A according to the first comparative embodiment is similar in configuration to the charging device 24 according to the exemplary embodiment except for the above-described feature.

In the first comparative embodiment, the power received by the conductive bearing 140 is not directly supplied to the shaft 72 of the charging roller 70 from the conductive bearing 140, but is supplied to the shaft 72 via the conductive paste 130 adhering to the shaft 72. The conductive paste 130 is thus caused to adhere to the shaft 72 to fill a gap between the shaft 72 and the conductive bearing 140 (a circumferential surface of the through-hole 94 thereof) and thereby reduce a variation in contact resistance. Since the conductive paste 130 is grease formed of a binder dispersed with conductive powder, however, the electrical resistance varies largely depending on the adhesion amount, the moisture absorption amount, the contact area, the thickness, and so forth. That is, in the first comparative embodiment, the time rate of change of the amount of power supply to the charging roller 70 is high (defective power supply). Consequently, the charge amount (charge potential) in the circumferential direction of the photoconductor 22 may vary in the first comparative embodiment.

By contrast, the exemplary embodiment brings the spring 100 (the linear spring 104) into (direct) contact with the charging roller 70 (see FIGS. 2 and 3), unlike supplying the power received by the coil spring 102 to the charging roller 70 via the conductive bearing 140. That is, the exemplary embodiment does not use the conductive paste 130.

In the power supply structure 25 according to the exemplary embodiment, therefore, the time rate of change of the amount of power supply to the charging roller 70 is lower than in the case in which the coil spring 102 supplied with power presses the conductive bearing 140 to supply the power to the charging roller 70 via the conductive bearing 140. Accordingly, defective charging attributed to the defective power supply is more suppressed in the charging device 24 (the cartridge 21) according to the exemplary embodiment than in the case in which the coil spring 102 supplied with power presses the conductive bearing 140 to supply the power to the charging roller 70 via the conductive bearing 140. Further, in the image forming apparatus 10 according to the exemplary embodiment, defective image formation attributed to the defective charging is more suppressed than in the case in which the coil spring 102 supplied with power presses the conductive bearing 140 to supply the power to the charging roller 70 via the conductive bearing 140.

Second Function

The second function is provided by the configuration of the spring 100 including the coil spring 102 and the linear spring 104 extending from the coil spring 102, that is, the configuration in which the coil spring 102 and the linear spring 104 are integrated together. The second function will be described below in comparison of the exemplary embodiment with the second comparative embodiment.

Figure 5:
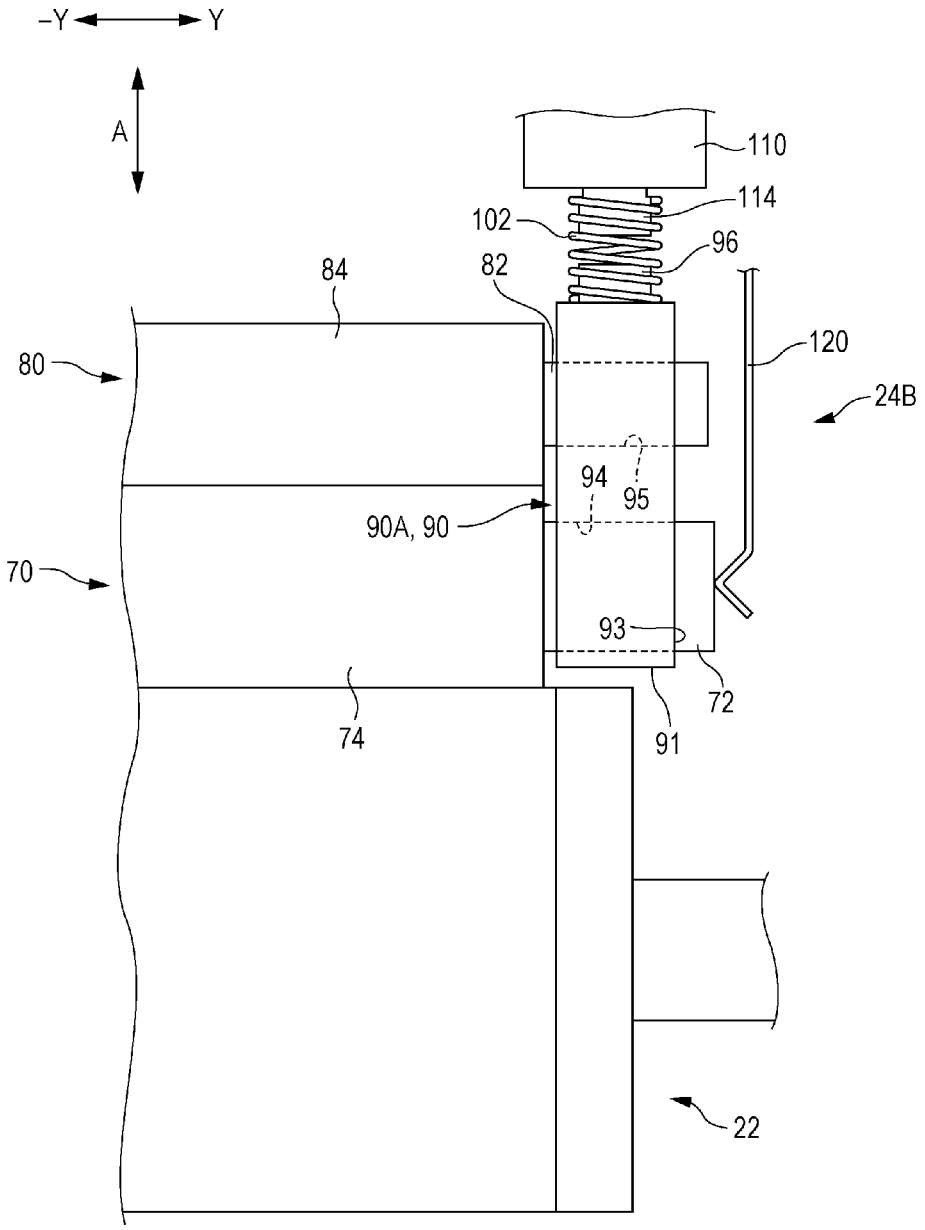
FIG. 5 is a schematic diagram illustrating parts of the photoconductor and a charging device according to a second comparative embodiment, as viewed in the direction intersecting the axial direction of the charging roller.

A charging device 24B according to the second comparative embodiment (see FIG. 5) includes the coil spring 102 and a leaf spring 120 in place of the spring 100 of the charging device 24 according to the exemplary embodiment (see FIG. 3). Herein, the leaf spring 120 is supported by the cartridge 21. Further, the charging device 24B presses the bearing 90A with the coil spring 102, and supplies power to the charging roller 70 from the leaf spring 120 connected to the high-voltage power supply 50. The charging device 24B according to the second comparative embodiment is similar in configuration to the charging device 24 according to the exemplary embodiment except for the above-described feature.

In the second comparative embodiment, if the charging roller 70 vibrates in the first direction in accordance with the rotation of the photoconductor 22, the position of contact of the leaf spring 120 with the charging roller 70 is displaced. Consequently, the contact resistance on a power supply path changes in the second comparative embodiment. In the second comparative embodiment, the member for pressing the bearing 90A (the coil spring 102) and the member for supplying power to the charging roller 70 (the leaf spring 120) are formed as separate members.

By contrast, in the exemplary embodiment, if the charging roller 70 vibrates in the first direction in accordance with the rotation of the photoconductor 22, the linear spring 104 is displaced together with the bearing 90A in synchronization with the vibration. In the exemplary embodiment, therefore, the linear spring 104 vibrates in synchronization with the bearing 90A, and thus the contact resistance is unlikely to change.

In the power supply structure 25 according to the exemplary embodiment, therefore, the time rate of change of the amount of power supply to the charging roller 70 is lower than in the case in which the member for pressing the bearing 90A and the member for supplying power to the charging roller 70 are formed as separate members and the member for supplying power to the charging roller 70 does not move in synchronization with the bearing 90A.

Third Function

The third function is provided by the contact of the linear spring 104 with the circumferential surface of the shaft 72 of the charging roller 70. The third function will be described below in comparison of the exemplary embodiment with the third comparative embodiment.

In a charging device according to the third comparative embodiment (illustration omitted), the linear spring 104 contacts with an end surface of the shaft 72 of the charging roller 70 to supply power to the charging roller 70, unlike the exemplary embodiment. The third comparative embodiment is similar in configuration to the exemplary embodiment except for the above-described feature. The third comparative embodiment has a configuration exhibiting the first and second functions, and thus is included in the technical scope of the invention.

In the third comparative embodiment, the charging roller 70 may be displaced in the axial direction thereof in accordance with the rotation of the photoconductor 22. Consequently, in the third comparative embodiment, the contact pressure, the contact area, and so forth of the linear spring 104 contacting with the end surface of the shaft 72 of the charging roller 70 may change in accordance with the displacement in the axial direction of the charging roller 70.

By contrast, in the exemplary embodiment, the linear spring 104 contacts with the circumferential surface of the shaft 72 of the charging roller 70 to supply power to the charging roller 70. Even if the charging roller 70 is displaced in the axial direction thereof in accordance with the rotation of the photoconductor 22, therefore, the contact pressure, the contact area, and so forth of the linear spring 104 contacting with the circumferential surface of the shaft 72 are unlikely to change.

In the power supply structure 25 according to the exemplary embodiment, therefore, the time rate of change of the amount of power supply to the charging roller 70 is lower than in the case in which the linear spring 104 contacts with an end surface of the shaft 72 of the charging roller 70 to supply power to the charging roller 70.

Fourth Function

The fourth function is provided by the protrusions 97 and 98 formed to support the linear spring 104 (the linear portion 104B). The fourth function will be described below in comparison of the exemplary embodiment with the fourth comparative embodiment.

A charging device according to the fourth comparative embodiment (illustration omitted) does not have the protrusions 97 and 98 for supporting the linear spring 104, unlike the exemplary embodiment. The fourth comparative embodiment is similar in configuration to the exemplary embodiment except for the above-described feature. The fourth comparative embodiment has a configuration exhibiting the first, second, and third functions, and thus is included in the technical scope of the invention.

Figure 2:
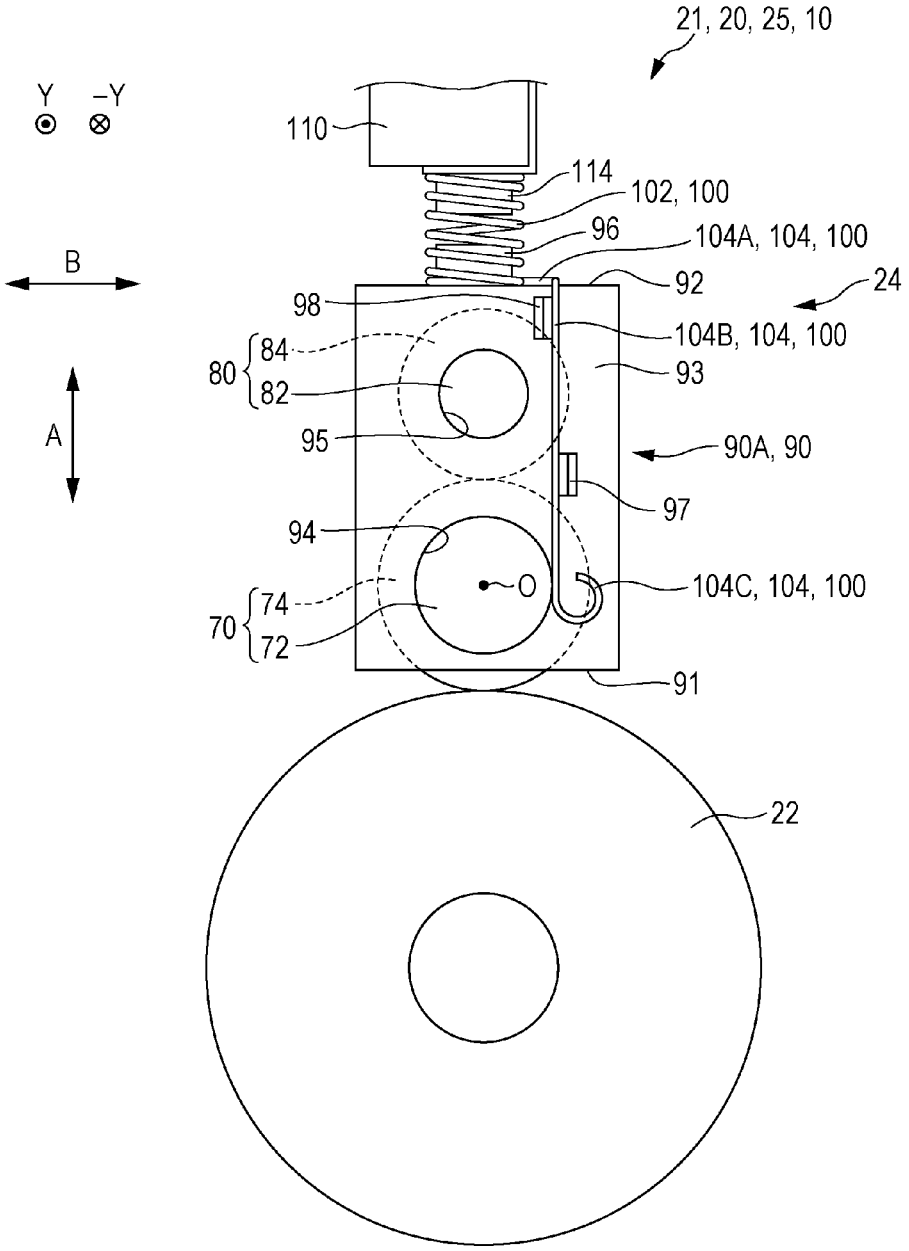
FIG. 2 is a schematic diagram illustrating parts of an integrated cartridge forming the image forming apparatus according to the exemplary embodiment, as viewed in the axial direction of a charging roller.

The linear spring 104 and the coil spring 102 integrally form the spring 100 (see FIGS. 2 and 3). The coil spring 102 not only receives power from the high-voltage power supply 50 but also presses the bearing 90A, as described above. That is, the wire diameter of the linear spring 104 formed integrally with the coil spring 102 is limited by the spring constant of the coil spring 102. Further, in the fourth comparative embodiment, the linear portion 104B of the linear spring 104 is not supported. It is therefore difficult to increase the contact pressure of the linear spring 104 (the linear portion 104B) contacting with the circumferential surface of the shaft 72 of the charging roller 70.

By contrast, in the exemplary embodiment, the linear spring 104 (the linear portion 104B) is supported by the protrusions 97 and 98. In the exemplary embodiment, therefore, it is possible to adjust the contact pressure of the linear spring 104 contacting with the circumferential surface of the shaft 72, irrespective of the wire diameter of the linear spring 104.

In the power supply structure 25 according to the exemplary embodiment, therefore, the time rate of change of the amount of power supply to the charging roller 70 is lower than in the case in which the protrusions 97 and 98 for supporting the linear spring 104 are absent.

Fifth Function

The fifth function is provided by the protrusions 97 and 98 formed on the bearing 90A to support the linear spring 104 (the linear portion 104B). The fifth function will be described below in comparison of the exemplary embodiment with the fifth comparative embodiment.

In a charging device according to the fifth comparative embodiment (illustration omitted), the protrusions 97 and 98 for supporting the linear spring 104 are formed not on the bearing 90A but on a wall of the cartridge 21 (illustration omitted), unlike the exemplary embodiment. The fifth comparative embodiment is similar in configuration to the exemplary embodiment except for the above-described feature. The fifth comparative embodiment has a configuration exhibiting the first, second, third, and fourth functions, and thus is included in the technical scope of the invention.

In the fifth comparative embodiment, if the charging roller 70 vibrates in the first direction in accordance with the rotation of the photoconductor 22, the respective positions of the protrusions 97 and 98 supporting the linear spring 104 are relatively displaced with respect to the bearing 90A. Consequently, in the fifth comparative embodiment, the contact pressure, the contact area, and so forth of the linear spring 104 contacting with the shaft 72 of the charging roller 70 may change in accordance with the displacement of the charging roller 70.

By contrast, in the exemplary embodiment, the linear spring 104 (the linear portion 104B) is supported by the protrusions 97 and 98 on the side surface 93 of the bearing 90A. Accordingly, the contact pressure, the contact area, and so forth of the linear spring 104 contacting with the circumferential surface of the shaft 72 are unlikely to change, even if the charging roller 70 is displaced in accordance with the rotation of the photoconductor 22.

In the power supply structure 25 according to the exemplary embodiment, therefore, the time rate of change of the amount of power supply to the charging roller 70 is lower than in the case in which the protrusions 97 and 98 for supporting the linear spring 104 are formed on a portion other than the bearing 90A.

Although a specific exemplary embodiment of the invention has been described in detail as above, the technical scope of the invention is not limited to the foregoing exemplary embodiment. For example, the technical scope of the invention also includes the following forms.

In the foregoing description of the exemplary embodiment, the bearing 90A has an insulating property. However, the bearing may have conductivity if a configuration is provided which supplies power to the rotary member by bringing the spring 100 into direct contact with the rotary member. In this case, conductive paste may be applied to a slide surface of the conductive bearing.

In the foregoing description of the exemplary embodiment, the bearing 90A has a rectangular parallelepiped shape, for example. However, the shape of the bearing is not limited to the rectangular parallelepiped shape if the bearing is capable of supporting the rotary member supplied with power.

In the foregoing description of the exemplary embodiment, the coil spring 102 serves as the spring for pressing the bearing 90A toward the photoconductor 22. However, the spring for pressing the bearing 90A may not necessarily be the coil spring 102 if the spring is capable of receiving power from the high-voltage power supply 50 and pressing the bearing 90A toward the photoconductor 22. For example, a leaf spring (illustration omitted) or any other spring may be employed.

Figure 6:
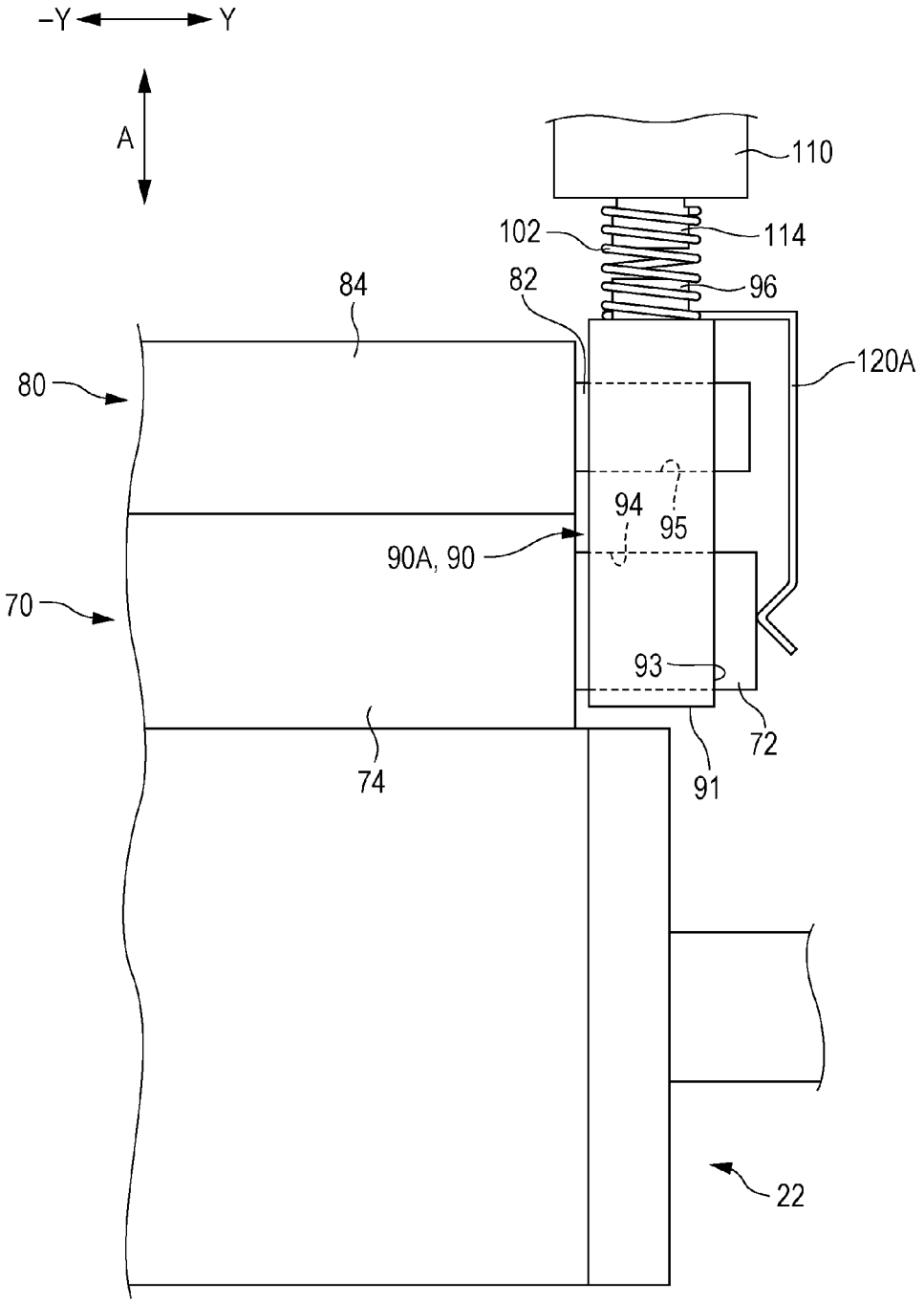
FIG. 6 is a schematic diagram illustrating parts of an integrated cartridge according to a modified example, as viewed in the direction intersecting the axial direction of the charging roller.

In the foregoing description of the exemplary embodiment, the coil spring 102 (an example of the first spring) and the linear spring 104 (an example of the second spring) integrally form the spring 100. As illustrated in FIG. 6, however, the coil spring 102 and a leaf spring 120A may be connected together (welded together, for example) to integrally form the spring 100, for example. In this case, the leaf spring 120A is an example of the second spring.

Figure 7:
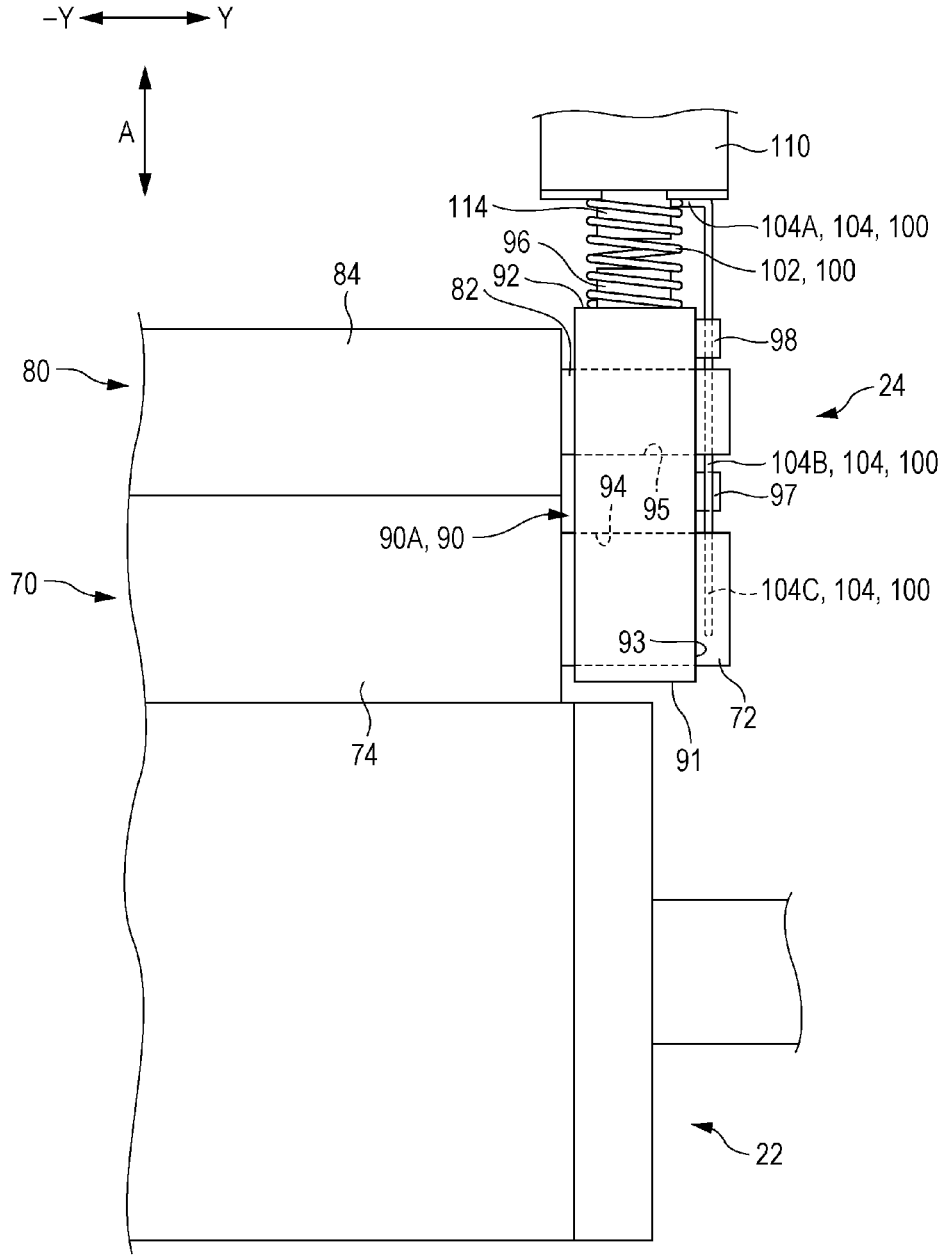
FIG. 7 is a schematic diagram illustrating parts of an integrated cartridge according to another modified example, as viewed in the direction intersecting the axial direction of the charging roller.

In the foregoing description of the exemplary embodiment, the linear spring 104 is provided to extend from the end portion of the coil spring 102 on the side of the end surface 92 (the side contacting with the bearing 90A) toward the end surface 91 (toward the photoconductor 22). However, the linear spring 104 may not necessarily extend from the end portion of the coil spring 102 on the side of the end surface 92 if the linear spring 104 is provided to extend from the coil spring 102. For example, as illustrated in FIG. 7, the linear spring 104 may be provided to extend from the end portion of the coil spring 102 on the side of the wall 110 of the cartridge 21 toward the end surface 91 (toward the photoconductor 22).

In the foregoing description of the exemplary embodiment, the power is supplied to the charging roller 70 from the side of the bearing 90A on the near side in the apparatus depth direction. However, the power may be supplied to the charging roller 70 with another bearing 90A and another spring 100 similar in configuration to those on the near side also provided on the depth side in the apparatus depth direction.

In the foregoing description of the exemplary embodiment, the charging device 24 includes the CLR 80. Needless to say, however, a configuration not including the CLR 80 is also included in the technical scope of the invention.

In the foregoing description of the exemplary embodiment, the power supply structure 25 is an example of the power supply structure, and the charging roller 70 is an example of the rotary member. However, the rotary member may be other than the charging roller. For example, the rotary member may be a transfer roller, a developing roller, or any other rotary member that is supplied with power.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A power supply structure comprising:

a bearing that supports a plurality of rotary members, the plurality of rotary members including a first rotary member that axially rotates while contacting with a contact target, and a second rotary member that axially rotates while contacting with the first rotary member;

a first spring that, while receiving power, contacts with and presses the bearing with an end portion of the first spring to bring the first rotary member into contact with the contact target; and a second spring that extends from the first spring toward the contact target and contacts with the first rotary member, and does not contact with the second rotary member, wherein a portion of the second spring that contacts the first rotary member is bent away from the first rotary member in a circular arc shape, and the second rotary member is positioned between the first spring and the first rotary member.

2. The power supply structure according to claim 1, wherein the rotary member includes a rotary shaft and a contact portion that is provided around an outer circumference of the rotary shaft with at least one end of the rotary shaft projecting from the contact portion and contacts with the contact target, and wherein the second spring contacts with the outer circumference of the one end of the rotary shaft.

3. The power supply structure according to claim 2, further comprising protrusions that support the second spring, wherein the second spring supported by the protrusions contacts with the outer circumference of the one end of the rotary shaft while pressing the rotary shaft.

4. The power supply structure according to claim 3, wherein the protrusions are formed on the bearing.

5. A charging device comprising:

the power supply structure according to claim 1; and a charging member that serves as the rotary member that axially rotates while contacting with the contact target, which is a member to be charged.

6. An assembly integrally comprising the charging device according to claim 5 and the member to be charged, and attachable to a body of an image forming apparatus.

7. An image forming apparatus comprising:

the charging device according to claim 5, the member to be charged, a latent image forming unit that forms a latent image on the member to be charged;

a developing unit that develops the latent image formed by the latent image forming unit into a toner image with toner; and a transfer unit that transfers the toner image onto a medium.

8. A power supply structure comprising:

a bearing that supports a plurality of rotary members, the plurality of rotary members including a first rotary that axially rotates while contacting with a contact target, and a second rotary member that axially rotates while contacting with the first rotary member, wherein the bearing has a through-hole that is aligned in a radial direction of the contact target;

a first spring that, while receiving power, contacts with and presses the bearing with an end portion of the first spring to bring the first rotary member into contact with the contact target;

a second spring that extends from the first spring toward the contact target and contacts with the first rotary member, and does not contact with the second rotary member; and protrusions that support the second spring, wherein a shaft of the second rotary member is disposed in the through-hole, and the protrusions are formed on the bearing and are positioned at opposite sides of the through-hole and at opposite sides of the shaft of the second rotary member.

9. A power supply structure comprising:

a bearing that supports a plurality of rotary members, the plurality of rotary members including a first rotary member that axially rotates while contacting with a contact target, and a second rotary member that axially rotates while contacting with the first rotary member;

a first spring that, while receiving power, contacts with and presses the bearing with an end portion of the first spring to bring the first rotary member into contact with the contact target;

a second spring that extends from the first spring toward the contact target and contacts with the first rotary member, and does not contact with the second rotary member; and protrusions that support the second spring, wherein the protrusions are formed on the bearing and are positioned linearly with the second spring along a same side of the bearing and at opposite sides of a shaft of the second rotary member.

* * * * *